US006817763B2

(12) United States Patent
Tomic

(10) Patent No.: US 6,817,763 B2
(45) **Date of Patent: *Nov. 16, 2004**

(54) LEAK-PROOF PACKAGE DESIGN INCLUDING RECLOSABLE ZIPPER HAVING SLIDER INCLUDING A FULL-LENGTH PLOW

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/284,701

(22) Filed: Oct. 30, 2002

(65) Prior Publication Data

US 2004/0086206 A1 May 6, 2004

(51) Int. Cl.[7] ..... B65D 33/16
(52) U.S. Cl. ..... 383/64; 383/59; 24/400
(58) Field of Search ..... 383/63, 64, 59; 24/599, 400, 585.12

(56) References Cited

U.S. PATENT DOCUMENTS

| | | | | | |
|---|---|---|---|---|---|
| 2,777,181 | A | | 1/1957 | Morner | |
| 2,997,765 | A | | 8/1961 | Markoff-Moghadam | |
| 3,115,689 | A | | 12/1963 | Jacobs | |
| 3,122,807 | A | | 3/1964 | Ausnit | |
| 5,067,208 | A | | 11/1991 | Herrington, Jr. et al. | |
| 5,216,787 | A | | 6/1993 | Custer et al. | |
| 5,871,281 | A | * | 2/1999 | Stolmeier et al. | 383/64 |
| 5,924,173 | A | | 7/1999 | Dobreski et al. | |
| 5,988,880 | A | * | 11/1999 | Tomic | 383/63 |
| 6,088,887 | A | | 7/2000 | Bois | |
| 6,220,754 | B1 | | 4/2001 | Stiglic et al. | |
| 6,286,189 | B1 | | 9/2001 | Provan et al. | |
| 6,287,001 | B1 | | 9/2001 | Buchman | |
| 6,293,701 | B1 | | 9/2001 | Tomic | |
| 6,305,844 | B1 | * | 10/2001 | Bois | 383/64 |
| 6,461,042 | B1 | * | 10/2002 | Tomic et al. | 383/64 |
| 6,481,890 | B1 | * | 11/2002 | VandenHeuvel | 383/64 |
| 6,581,253 | B2 | * | 6/2003 | ErkenBrack | 24/428 |
| 6,582,122 | B2 | * | 6/2003 | Shimizu | 383/63 |
| 6,609,827 | B2 | * | 8/2003 | Bois et al. | 383/59 |
| 6,632,021 | B2 | * | 10/2003 | Bois et al. | 383/59 |
| 6,698,926 | B2 | * | 3/2004 | Buchman | 383/64 |

* cited by examiner

*Primary Examiner*—Jes F. Pascua
(74) *Attorney, Agent, or Firm*—Tracey D. Beiriger

(57) ABSTRACT

A reclosable zipper closure and slider device for use with packages to open and close a pair of mating closure profiles. The closure profiles of the zipper closure include a male closure profile having a first interlocking member that is received by at least one second interlocking member formed on a female closure profile. The male closure profile further includes a sealing protrusion that is received within a mating sealing recess to provide a liquid tight seal between the two closure profiles. The slider device includes a plow member that extends past the first interlocking member when the slider device is installed on the zipper closure. Each of the closure profiles includes a spring member that contacts the top, inner surface of the slider device to provide a resilient, flexible structure to aid in installation of the slider device on the zipper closure.

21 Claims, 5 Drawing Sheets

LEAK-PROOF PACKAGE DESIGN INCLUDING RECLOSABLE ZIPPER HAVING SLIDER INCLUDING A FULL-LENGTH PLOW

FIELD OF THE INVENTION

The present invention generally relates to a leak-proof reclosable package, such as a plastic bag, that includes a zipper closure arrangement. More specifically, the present invention relates to a zipper closure arrangement having reclosable profiles and a slider device having a full-length plow to open and close the profiles as the slider is moved along the length of the profiles.

BACKGROUND OF THE INVENTION

Many packaging applications use reclosable containers to store various types of articles and materials. These packages may be used to store and ship food products, non-food consumer goods, medical supplies, waste materials, and various other types of articles. Reclosable packages are convenient in that they can be closed and resealed after the initial opening to preserve the enclosed contents. The need to locate a storage container for the unused portion of the product in the package is thus avoided. As such, providing products in a reclosable package appreciably enhances the marketability of these products.

Some types of reclosable packages are opened and closed using a slider device. The slider device typically includes a separator or plow-type structure in the middle or at one end that opens a zipper closure mechanism having male and female interlocking profiled elements or closure profiles when the slider device travels in a first direction along the zipper closure. The sidewalls of the slider device are inwardly tapered from one end to the opposite end so that the sidewalls engage the closure profiles and progressively move them into engagement to close the reclosable package when the slider device is moved along the zipper closure in a direction opposite to the first direction.

Reclosable packages that include a slider device to more easily open and close the profiles typically face problems in providing a liquid tight seal across the entire length of the zipper closure due to the fact that the slider includes a plow device used to separate the closure profiles as the slider is moved along the length of the zipper closure. Thus, a portion of the zipper closure beneath the plow remains open at all times. One way to solve this problem is to include a notch formed in the mating profiles above the interlocking elements to define a home position for the slider when the package is in a completely closed position. The notch formed in the profile typically receives the plow formed on the slider such that the profile can be closed on each side of the plow to create a continuous seal across the entire package. Typically, the plow of the slider device does not extend past the interlocking elements such that the notch does not create an opening between the interlocking elements formed on the closure profiles.

Although a notch formed in the mating profile on the closed end of the resealable package is known, problems can occur in utilizing such a notch with a full-length plow. For example, during the formation of the notch, portions of the resealable package near the location of the notch can be damaged which affects the performance of the package.

Therefore, it is an object of the present invention to provide an improved zipper closure mechanism and slider that creates a liquid tight seal across the entire length of the zipper closure. Further, it is an object of the present invention to provide a slider device for use on such a zipper closure mechanism that includes a one-piece, full-length plow for separating the mating closure profiles.

SUMMARY OF THE INVENTION

The present invention is directed to a reclosable, flexible package that includes a slider device and zipper closure that closes the mouth of the package. The slider device is movable along the zipper closure to engage and disengage a pair of closure profiles.

In accordance with the invention, the zipper closure includes a male closure profile and a female closure profile that engage each other to seal the zipper closure along the mouth of the product package. The slider device is positioned to move along the pair of closure profiles to engage and disengage the closure profiles as the slider device is moved.

The male closure profile includes a base wall having a first interlocking member extending therefrom. The female closure profile includes a second base wall including at least one second interlocking member extending from the base wall. The first and second interlocking members are constructed and arranged to selectively interlock to close the mouth of the flexible package.

The male closure profile includes a sealing protrusion that extends toward the female closure profile. In the preferred embodiment of the invention, the sealing protrusion is formed as part of the first base wall and is positioned between the first interlocking member and the open interior of the package, although other locations are contemplated as being within the scope of the present invention. The female closure profile includes a sealing recess that is sized to receive the sealing protrusion extending from the male closure profile. When the male and female closure profiles are interlocked, the sealing protrusion is received within the sealing recess to provide a fluid seal for the open package interior. In the preferred embodiment of the invention, the sealing recess formed on the female closure profile is positioned between the second interlocking member and the open package interior, although other locations are contemplated as being within the scope of the present invention.

The slider device includes a plow that depends from a top wall of the slider device. The plow extends toward the open package interior when the slider device is positioned along the zipper closure. The plow extends downward from the top wall and extends between the first interlocking member and the second interlocking member of the zipper closure. Thus, the slider device physically separates the first interlocking member and the second interlocking member as the slider device is moved along the zipper closure.

Preferably, the plow of the slider device is a one-piece member that has a pair of diverging sidewalls that separate the male closure profile and the female closure profile as the slider device is moved in a first direction.

The slider device includes an open interior that receives the male and female closure profile. Preferably, a pair of slider ribs are formed on the opposing sidewalls that define the open interior of the slider device. The slider ribs decrease in height from the first end of the slider device to a second end of the slider device. The increasing height of the slider ribs contact the male and female closure profiles to force the male and female closure profiles into an interlocking condition as the slider device moves in a second, opposite direction.

Both the male closure profile and the female closure profile include a spring member that contacts the inner surface of the top wall of the slider device. The spring members compensate for the size of the open interior of the slider device and aids in the installation of the slider device onto the zipper closure.

In accordance with the present invention, a notch or slit is formed in the zipper closure to define a home position for the slider device. The notch or slit formed in the zipper closure preferably extends through both the male and female closure profiles such that the plow formed on the slider device can be received in the notch or slit.

A first seal region is formed between the panels of the reclosable package beneath the notch formed in the zipper closure. The seal region provides a liquid tight seal beneath the notch formed in the zipper closure such that liquid is prevented from leaving the open interior of the package through the open closure around the plow or separator.

DETAILED DESCRIPTION OF PREFERRED EMBODIMENTS

Flexible packages having zipper closure mechanisms are common in today's packaging market. Typically, the zipper closure has a first and a second interlocking closure profile. The zipper closure provides easy opening and closing of the package mouth to gain access to the contents within the package interior. The addition of a slider device to a flexible package, such as a plastic bag, is advantageous to aging or arthritic persons not having the physical ability to use just a zipper closure to reseal a bag. Additionally, the use of a slider device with a flexible package facilitates the use of the bag by users of all ages and abilities.

Figure 1:
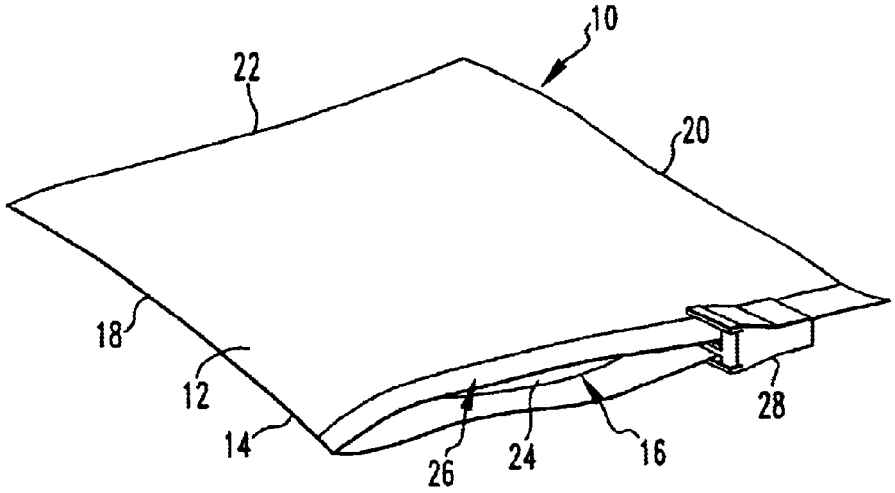
FIG. 1 is a perspective view of a flexible, reclosable package having a zipper closure mechanism and a slider device constructed in accordance with the present invention.

FIG. 1 illustrates a flexible, reclosable package 10. The flexible package 10 has a first and a second polymeric film side panels 12 and 14 defining an open interior 16. The flexible package includes a pair of side edges 18 and 20 and a bottom edge 22. The pair of side panels 12 and 14 are connected to each other along the side edges 18 and 20, as well as the bottom edge 22, to define the open interior 16 of the package 10. The first side edge 18 and the second side edge 20 are formed by seals created by the application of heat and pressure for a set period to the side panels 12 and 14.

As shown in FIG. 1, a mouth 24 provides access to the interior 16 of the package 10 long the top of the package 10. A zipper closure 26 is formed along the mouth 24 and extends from the first side edge 18 to the second side edge 20. The zipper closure 26 can include a variety of configurations and structures. A slider device 28 is mounted on the zipper closure 26 to facilitate opening and closing of the zipper closure 26.

Figure 2:
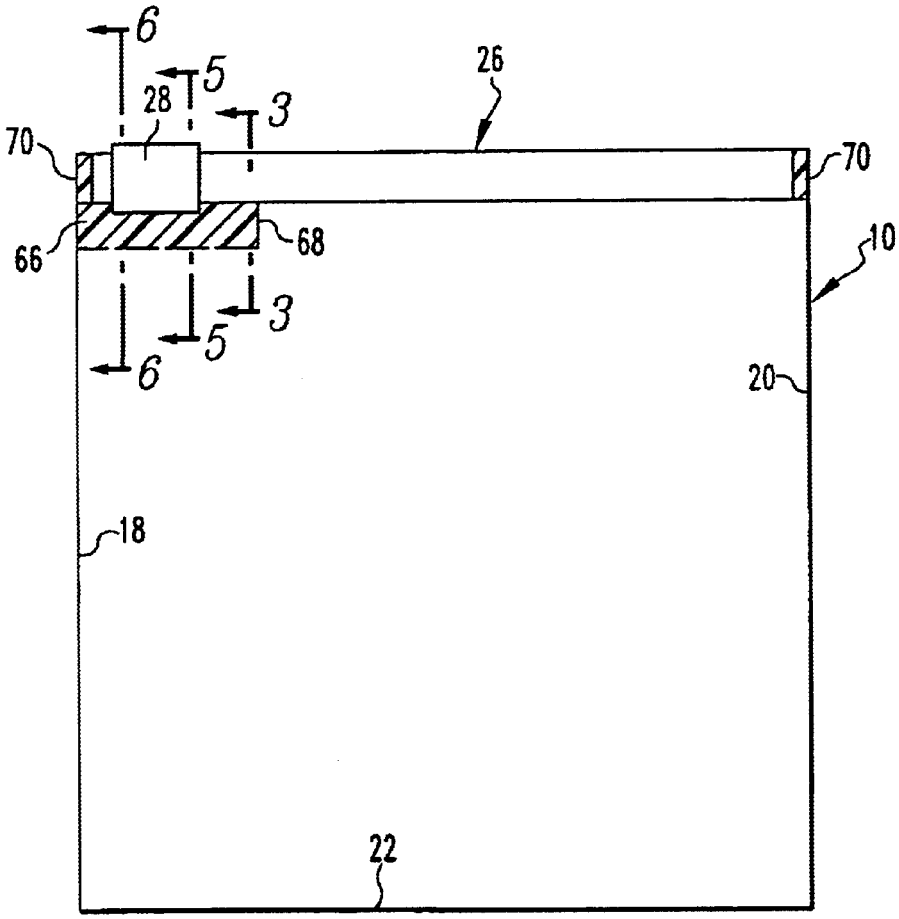
FIG. 2 is a side view of the reclosable package illustrating the slider device disposed upon the zipper closure mechanism in a home position.

Referring now to FIG. 2, the slider device 28 is shown positioned in a "home" position in which the zipper closure 26 is in its completely closed condition. In accordance with the present invention, when the slider device 28 is in the home position, the open interior of the reclosable package 10 is fluid tight to prevent the contents of the reclosable package 10 from leaving the package.

Figure 3:
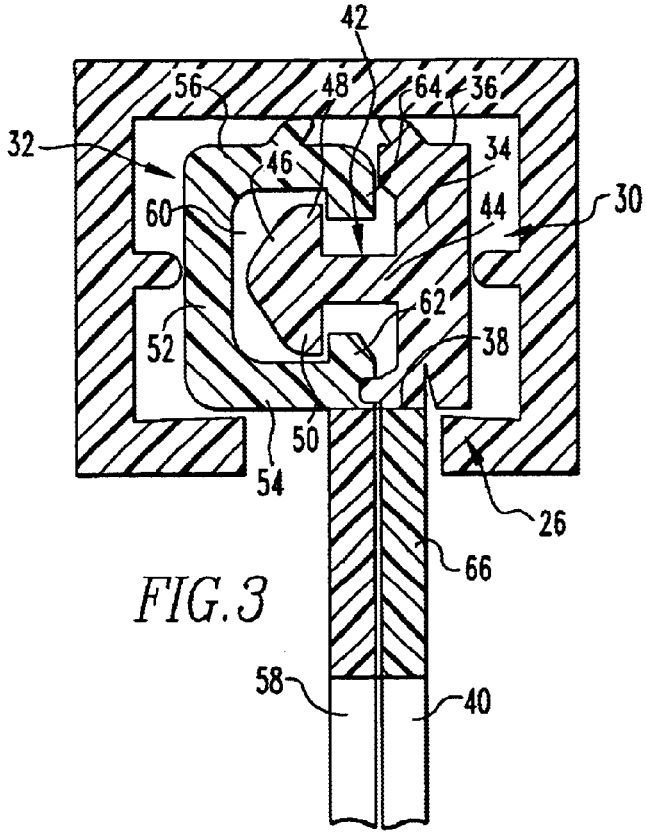
FIG. 3 is a section view taken along line 3—3 of FIG. 2 illustrating the interaction between the slider device and the male and female closure profiles of the closure mechanism.

Referring now to FIG. 3, the zipper closure 26 is formed from a male closure profile 30 and a female closure profile 32 that are configured to mate with each other and form a seal along the mouth of the reclosable package. The male closure profile 30 includes a first base wall 34 that extends from a first end 36 to a second end 38. The wall 34 is formed from an extruded plastic material in the preferred embodiment of the invention. The second end 38 of the base wall 34 of the male closure profile 30 is integrally formed with a sealing flange 40 that extends from the second end 38 and provides a point of attachment between the male closure profile 30 and one of the side panels of the reclosable package.

The male closure profile 30 further includes a first interlocking member 42 that extends from the base wall 34 toward the female closure profile 32. In the embodiment of the invention illustrated, the first interlocking member 42 includes a post 44 and a head 46 having a pair of opposing locking flanges 48 and 50. The locking flanges 48 and 50 interact with the female closure profile 32 to provide a positive interlock between the male closure profile 30 and the female closure profile 32, as will be described in detail below.

As can be seen in FIG. 3, the female closure profile 32 includes a second base wall 52 including a pair of second interlocking members 54 and 56 extending away from the second base wall 52 toward the male closure profile 30. The female closure profile 32 further includes a sealing flange 58 that is integrally formed with and extends from the second interlocking member 54 and provides a point of attachment for one of the side panels of the reclosable package.

As illustrated in FIG. 3, the combination of the second base wall 52 and the pair of second interlocking members 54 and 56 define an open channel 60 that receives the head 46 of the male closure profile 30. The head 46 is retained within the open channel 60 by a first locking finger 62 formed on the second interlocking member 54 and a second locking finger 64 formed on the second interlocking member 56. The locking fingers 62 and 64 engage the pair of locking flanges 48 and 50 formed on the first interlocking member 42 to securely hold the male closure profile 30 in engagement with the female closure profile 32.

Although the interlocking member 42 formed on the male closure profile 30 is shown as having a pair of locking flanges 48 and 50, it is contemplated by the inventor that either of the locking flanges 48 or 50 could be eliminated while providing an adequate retaining force to hold the male closure profile 30 in contact with the female closure profile 32. Additionally, other configurations for the first interlocking member 42 and the second interlocking members 54 and 56 are contemplated as being within the scope of the present invention.

Referring now to FIGS. 2 and 3, a first seal region 66 is formed between the male closure profile 30 and the female closure profile 32. Specifically, the first seal region 66 is formed between portions of the sealing flanges 40 and 58 formed on each of the closure profiles. As shown in FIG. 2, the seal region 66 extends toward the center of the package from the side edge 18 to an inner edge 68 such that the first seal region 66 has a defined length. As illustrated in FIG. 2, the defined length of the first seal region 66 is greater than the length of the slider device 28. The seal region 66 provides a fluid tight seal between the two sealing flanges 40 and 58 below the slider 28 when the slider is in its home position. As will be described in detail below, the seal between the two sealing flanges 40 and 58 prevents liquid from leaving the reclosable package 10 when the slider 28 is in the home position shown in FIG. 2. In the preferred embodiment of the invention, the first seal region 66 is formed utilizing any one of several sealing techniques, such as heat sealing or utilizing a waterproof adhesive material.

As illustrated in FIG. 2, the reclosable package 10 includes a crush region 70 formed along each of the side edges 18 and 20 of the reclosable package. The crush region 70 is formed between the two mating male and female profiles of the zipper closure 26 as is conventional in the manufacture of reclosable packages having a zipper closure.

Figure 6:
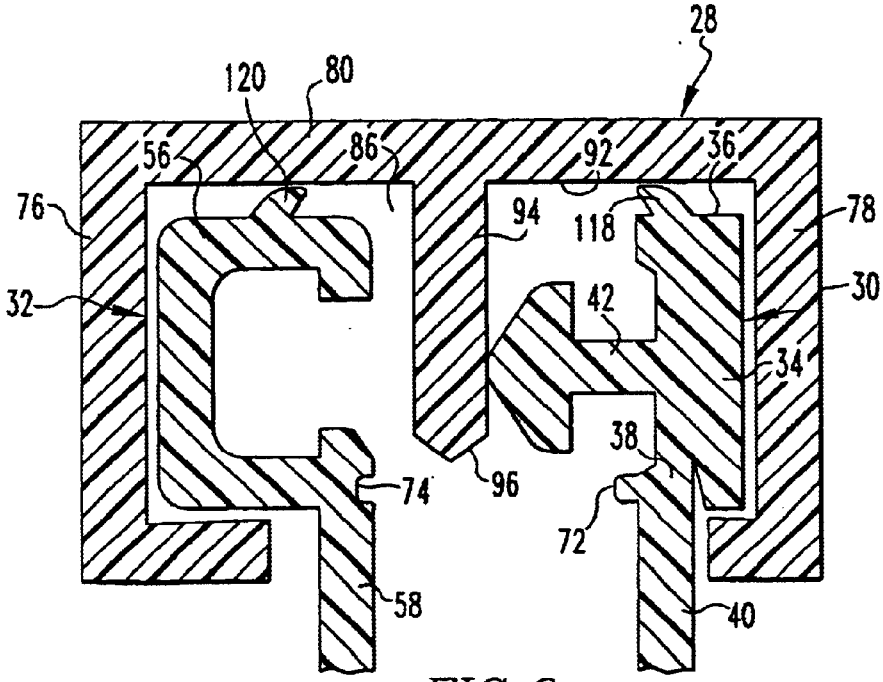
FIG. 6 is a section view taken along line 6—6 of FIG. 2 illustrating the separation of the male closure profile from the female closure profile by the full-length plow.

Referring now to FIG. 6, in the preferred embodiment of the invention, the male closure profile 30 includes a sealing protrusion 72 that extends in a direction away from the base wall 34 toward the female closure profile 32. The sealing protrusion 72 extends from the base wall 34 near the second end 38. In the first embodiment of the invention, the sealing protrusion 72 is positioned below the first interlocking member 42 and is independent from the first interlocking member 42.

Figure 5:
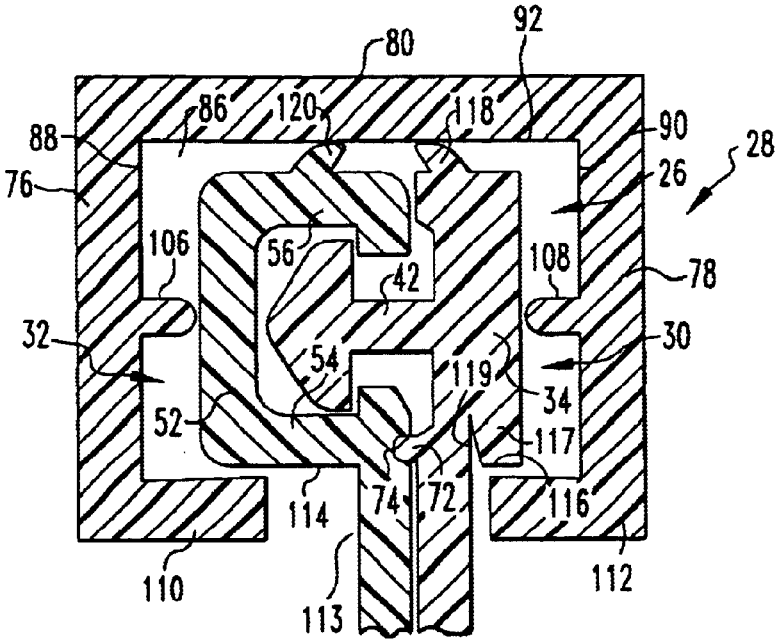
FIG. 5 is a section view taken along line 5—5 of FIG. 2 illustrating the interaction between the slider ribs of the slider device and the male and female closure profiles.

Referring still to FIG. 6, the female closure profile 32 includes a mating sealing recess 74. The sealing recess 74 is aligned with and sized to receive the sealing protrusion 72, as best illustrated in FIG. 5. As illustrated in FIG. 5, the interaction between the sealing protrusion 72 and the sealing recess 74 is below the interaction between the first interlocking member 42 and the second interlocking members 54 and 56. In the first embodiment of the invention illustrated, the interaction between the male and female closure profiles 30 and 32 hold the package mouth closed, while interaction between the sealing protrusion 72 and the sealing recess 74 provides a liquid tight seal beneath the male closure profile 30 and the female closure profile 32.

Figure 7:
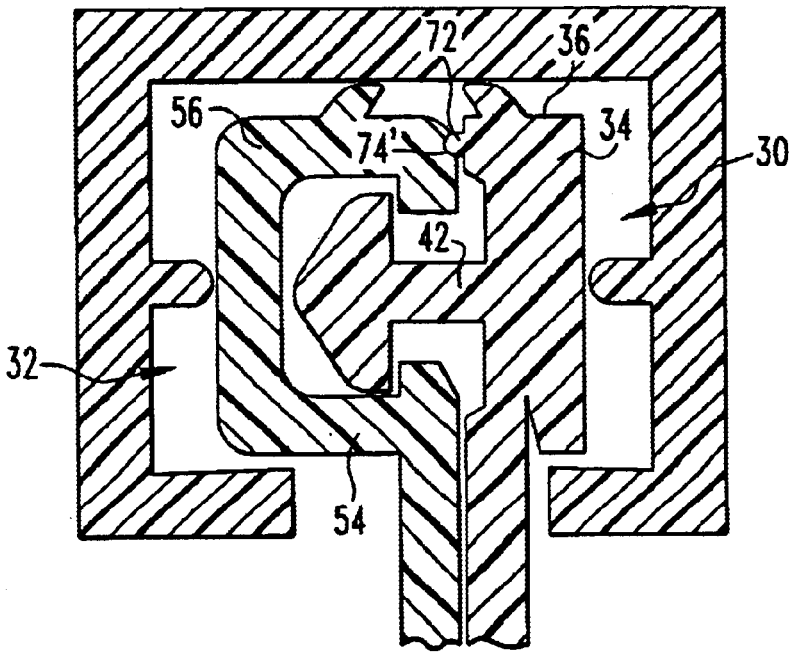
FIG. 7 is a section view similar to FIG. 5 illustrating a second embodiment of the male and female closure profiles of the closure mechanism.

Referring now to FIG. 7, thereshown is a second embodiment of the male closure profile 30 and the female closure profile 32 of the present invention. In the second embodiment of FIG. 7, the male closure profile 30 includes a sealing protrusion 72' that extends in a direction away from the base wall 34 and toward the female closure profile 32. The sealing protrusion 72' extends from the base wall 34 near the upper end 36. In the second embodiment of the invention, the sealing protrusion 72' is positioned above the first interlocking member 42 and is independent from the first interlocking member 42.

As illustrated in FIG. 7, the female closure profile 32 includes a mating sealing recess 74'. The sealing recess 74' is aligned with and sized to received the sealing protrusion 72'. The interaction between the sealing protrusion 72' and the sealing recess 74' is above the interaction between the first interlocking member 42 and the second interlocking members 54 and 56. In the second embodiment of the invention, the interaction between the male and female closure profiles 30 and 32 holds the package mouth closed, while the interaction between the sealing protrusion 72' and the sealing recess 74' provides a liquid tight seal.

Figure 8:
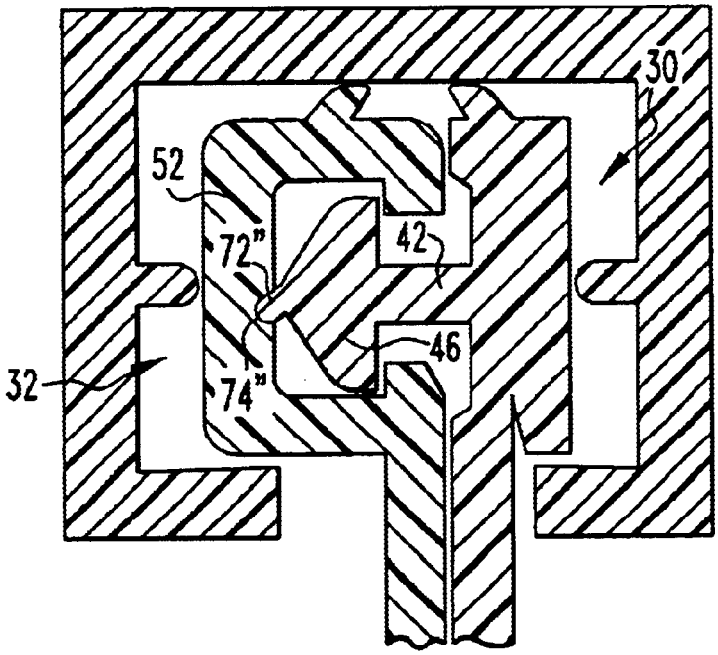
FIG. 8 is a section view similar to FIG. 5 illustrating a third embodiment of the male and female closure profiles of the closure mechanism.
Figure 9:
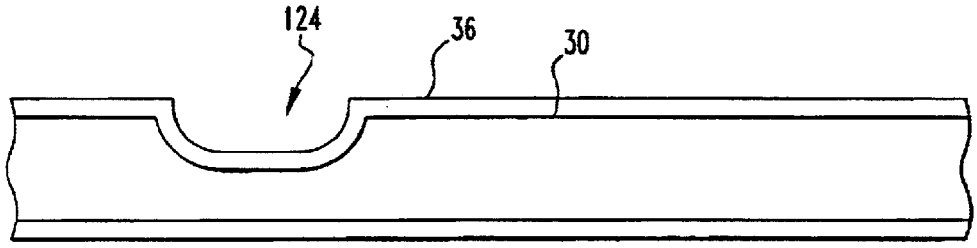
FIG. 9 is a side view of a portion of the reclosable package illustrating the position of a notch to define a home position for the slider device when the package is in a completely closed condition.
Figure 10:
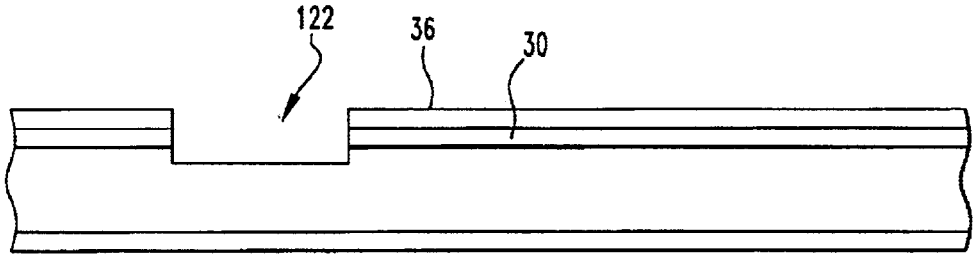
FIG. 10 is a side view of a portion of the reclosable package illustrating a second embodiment of a notch that defines a home position for the slider device when the package is in a completely closed condition.

Referring now to FIG. 8, thereshown is a third embodiment of the male closure profile 30 and the female closure profile 32. In the third embodiment of the invention, the head 46 of the first interlocking member 42 includes a sealing protrusion 72" that extends at a downward angle toward the female closure profile 32. The sealing protrusion 72" is received within a mating sealing recess 74" that also is oriented at a downward angle and is formed in the second base wall 52 of the female closure profile 32.

As illustrated in FIG. 8, the interaction between the sealing protrusion 72" and the sealing recess 74" provides a liquid tight seal between the male closure profile 30 and the female closure profile 32. The downward angle of the protrusion and the recess increases the ease at which the male and female closure profile can be mated and is the most preferred configuration. However, it is contemplated by the inventor that the sealing protrusion 72" and the sealing recess 74" could be angled upward or extend horizontally while operating within the scope of the present invention.

Figure 4:
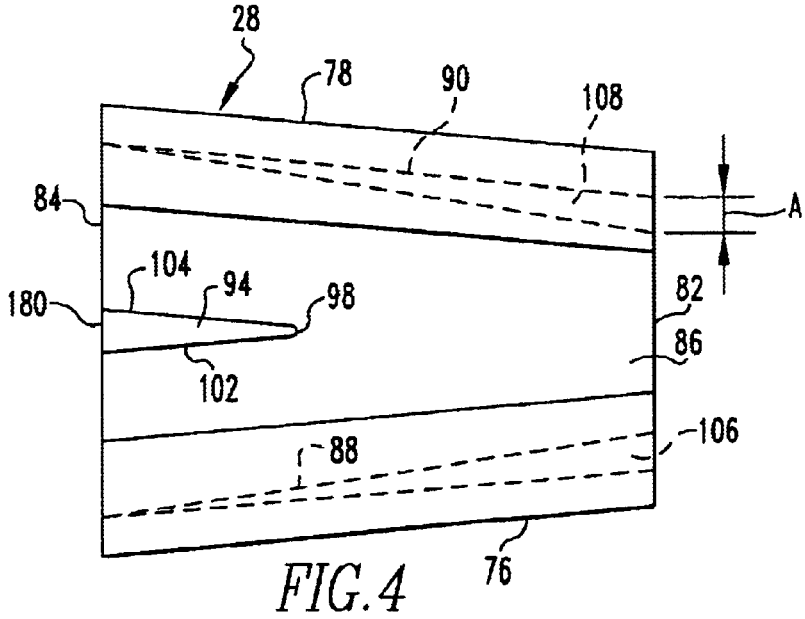
FIG. 4 is a bottom view of the slider device of the present invention.

Referring now to FIGS. 5 and 6, the slider device 28 of the present invention is illustrated positioned along the zipper closure 26 consisting of the male closure profile 30 and the female closure profile 32. The slider device 28 is formed from a first sidewall 76 and a second sidewall 78 that each depend from a top wall 80. As illustrated in FIG. 4, the sidewalls 76 and 78 taper from a first, leading end 82 to a second, trailing end 84.

As illustrated in FIG. 5, the combination of the sidewalls 76 and 78, with the top wall 80, define an open cavity 86 in the slider device 28 that receives the male closure profile 30 and the female closure profile 32. The open cavity 86 is defined by the inner surfaces 88 and 90 of the sidewalls 76 and 78, respectively, as well as the inner surface 92 of the top wall 80.

As illustrated in FIGS. 4 and 6, the slider device 28 includes a plow 94 that extends from the top wall 80. The plow 94 is centrally located between the pair of spaced sidewalls 76 and 78 and extends downward from the top wall 80 to a bottom end 96. In the embodiment of the invention illustrated in FIG. 6, the bottom end 96 of the plow 94 is pointed, which aids in the installation of the slider device 28 onto the zipper closure.

As illustrated in FIG. 4, the plow 94 extends lengthwise into the main body of the slider device 28 from the second, trailing end 84 to an engagement tip 98. As illustrated, the plow 94 is a unitary structure increasing in width from the engagement tip 98 to the trailing end 100 and is defined by a pair of side surfaces 102 and 104. The divergence of the side surfaces 102 and 104 from the engagement tip 98 separates the male closure profile from the female closure profile when the slider device 28 is moved in a first direction along the zipper closure, such as to the right in FIG. 2.

Referring back to FIG. 6, the plow 94 of the present invention is a full-length plow such that the bottom end 96 of the plow 94 extends past the first interlocking member 42.

Thus, during movement of the plow 28 in the first direction to separate the male closure profile 30 from the female closure profile 32, the plow 94 is positioned between the two closure profile members, as illustrated in FIG. 6.

Referring now to FIG. 5, both of the sidewalls 76 and 78 of the plow 28 include a slider rib 106 and 108. As illustrated in FIG. 5, the slider rib 106 contacts the female closure profile 32 while the slider rib 108 contacts the male closure profile 30 to push the closure profiles into engagement with each other to create the interlock between the two profiles.

Referring to FIG. 4, the height of the slider ribs 106 and 108 decreases from a first height A at the first, leading end 82 of the slider device 28 to no height at the second, trailing end 84. As can be understood in FIGS. 4–6, the height of the slider ribs 106 and 108 urges the female closure profile 32 into engagement with the male closure profile 30 as the slider device 28 is moved along the zipper closure 26 to create the desired interlock between the two components. Further, the slider ribs 106 and 108 engage the middle of each of the base walls 52 and 34 to insure the most positive interaction between the two mating closure profiles 30 and 32.

Referring now to FIG. 5, the slider device 28 includes an extending flange 110 protruding from the sidewall 76 and a corresponding flange 112 extending from the second sidewall 78. The flanges 110 and 112 are separated by a central opening 113 that allows the slider device 28 to be positioned onto the zipper closure.

When the slider device is installed as illustrated in FIG. 5, the flange 110 interacts with a lower shoulder 114 formed as part of the female closure profile 32. Likewise, the flange 112 interacts with a shoulder 116 formed on the male closure profile 30. As illustrated, the shoulder 116 is formed on a flexible finger 117 separated from the base wall 34 by a hinge channel 119. The flexible finger 117 and hinge channel 119 aid in the installation of the slider device 28 on the zipper closure.

The interaction between the pair of flanges 110 and 112 and the shoulders 114 and 116 prevent the slider device 28 from becoming separated from the zipper closure. As illustrated in FIG. 5, the pair of flanges 110 and 112 are positioned generally parallel to each other, as are the shoulders 114 and 116 defined by the closure profiles.

Referring back to FIG. 6, in the preferred embodiment of the invention both the male closure profile 30 and the female closure profile 32 include a pair of spring members 118 and 120. Specifically, the spring member 118 extends from the first end 36 of the base wall 34 while the spring member 120 extends from the second interlocking member 56. Each of the spring members 118, 120 is formed from the same plastic material used to form the male and female closure profiles 30, 32, respectively.

As illustrated in FIG. 6, each of the spring members 118, 120 contacts the inner surface 92 of the top wall 80 to stabilize the slider device 28 along the zipper closure. Each of the spring members 118, 120 deflect downward when the slider device 28 is initially installed onto the zipper closure. The spring members 118, 120 thus allow the open cavity 86 to be slightly larger than the male and female closure profiles 30 and the slider device 28 is easier to install during the creation of the reclosable package 10.

During creation of the reclosable package 10, the slider device 28 is installed into the zipper closure 26 by pressing the slider device 28 downward onto the zipper closure 26 when the zipper closure 26 is in an aligned open condition. As the slider device 28 is pressed downward, the pair of flanges 110 and 112 compress the zipper closure 26 until the flanges 110 and 112 reach the shoulders 114 and 116. The flexible finger 117 formed on the male closure profile 30 flexes inward along the hinge channel 119 to aid in the installation of the slider device 28.

As the slider device 28 is installed, the full-length plow 94 traverses the male and female closure profiles 30, 32, as illustrated in FIG. 6. The spring members 118 and 119 exert a force onto the inner surface 92 of the top wall 80 to maintain the proper positioning of the slider device 28 along the zipper closure 26. As illustrated in FIG. 6, the full-length plow 94 traverses the male and female closure profiles 30 and 32 such that the slider device 28 can be installed anywhere along the length of the zipper closure 26. Movement of the slider device 28 along the zipper closure 26 opens and closes the zipper closure as desired.

As can be understood in FIGS. 5 and 6, the slider device 28 contacts the female closure profile 32 at only three distinct points, which aids in reducing the amount of drag of the slider as it moves along the zipper closure. Specifically, the female closure profile 32 contacts the slider device 28 at the slider rib 106, the spring member 120 and along the shoulder 114. Likewise, the slider device 28 contacts the male closure profile 30 at the point of interaction with the spring member 118, the slider rib 108 and the interaction between the shoulder 116. These minimum points of contact between the slider device 28 and the zipper closure decreases the drag of the slider 28 as it traverses the zipper closure.

Referring back to FIG. 2, when the slider device 28 is in the home position illustrated, the full-length plow 94 is positioned between the first interlocking member 42 of the male closure profile 30 and the second interlocking members 54, 56 of the female closure profile. Thus, without any additional manufacturing steps, the closure profiles would be separated at some position at all times, even when the slider device 28 is in its home position. As previously described, a first seal region 66 is positioned beneath the slider device 28 when it is in the home position. The first seal region 66, in combination with the interaction between the sealing protrusion 72 and the sealing recess 74, prevents the flow of liquid out of the open interior past the slider device 28.

Although the combination of the first seal region 66 and the sealing protrusion 72 formed on the male closure profile prevents the flow of liquid past the slider device, a notch or slit 122 can be formed in the male closure profile 30 and/or the female closure profile, as illustrated in FIG. 8. The notch or slit 122 extends downward from the upper end 36 of the male closure profile 30 a distance that is greater than the length of the plow 94. Thus, when the slider device is positioned in alignment with the notch or slit 122, the slider device no longer separates the male and female closure profiles.

In addition to the notch 122 shown in FIG. 8, which is cut from the male and female closure profiles, a melted notch 124 can also be used, as shown in FIG. 7. The melted notch 124 functions the same as the notch 122 to provide a place for the full-length plow to rest when the slider device is in its closed position.

Having described the presently preferred embodiments, it is to be understood that the invention may be otherwise embodied within the scope of the appended claims.

What is claimed is:

1. A closure mechanism for use on a reclosable, flexible package, the closure mechanism comprising:

a male closure profile having a first base wall, the first base wall including a first interlocking member extending therefrom;

a female closure profile having a second base wall including at least one second interlocking member extending therefrom;

wherein the first interlocking member and the second interlocking member are constructed and arranged to selectively interlock, said female closure profile further comprising a spring member extending from the second interlocking closure member and the male closure profile further comprising a spring member extending from a first end of the first base wall, said spring members aiding the mounting of a slider device on said closure mechanism;

the male closure profile further comprising a scaling protrusion extending in a direction toward the female closure profile; and the female closure profile further comprises a sealing recess sized and located to receive the sealing protrusion extending from the male closure profile when the first interlocking member and the second interlocking member are interlocked.

2. The closure mechanism of claim 1 wherein the spring member formed on the male closure profile is formed on a top end of the first base strip and the sealing protrusion is formed on a bottom end of the first base wall.

3. The closure mechanism of claim 2 wherein the female closure profile includes a pair of second interlocking members spaced from each other to define an open channel, the open channel being sized to receive the first interlocking member.

4. A reclosable flexible package comprising:

a pair of side panels joined along a first side edge and a second side edge, the panels defining a mouth providing access to a package interior;

a zipper closure positioned along the mouth of the package for selectively opening and closing the package mouth, the zipper closure including a male closure profile and a female closure profile each constructed and arranged to selectively interlock with each other to hold the mouth in a closed position;

the male closure profile having a first base wall including a first interlocking member extending therefrom;

the female closure profile having a second base wall including at least one second interlocking member extending therefrom;

wherein the first and second interlocking members are constructed and arranged to selectively interlock to hold the mouth in a closed position, said female closure profile further comprising a spring member extending from the interlocking closure member and the male closure profile further comprising a spring member extending from the first base wall, said spring members siding the mounting of a slider device on said closure mechanism;

the male closure profile further comprising a sealing protrusion extending in a direction toward the female closure profile; and the female closure profile further comprising a sealing recess sized and located to receive the sealing protrusion extending from the male closure profile when the interlocking members of the male closure profile and the female closure profile are interlocked.

5. The reclosable package of claim 4 wherein the sealing protrusion is formed on the male closure profile between the first interlocking member and the package interior and the sealing recess is formed on the female closure profile between the second interlocking member and the package interior.

6. A reclosable flexible package comprising:

a pair of side panels joined along a first side edge and a second side edge, the panels defining a mouth providing access to a package interior;

a zipper closure positioned along the mouth of the package for selectively opening and closing the package mouth, the zipper closure including a male closure profile and a female closure profile each constructed and arranged to interlock with each other to hold the mouth in a closed position;

the male closure profile having a first base wall including a first interlocking member extending therefrom;

the female closure profile having a second base wall including at least one second interlocking member extending therefrom;

wherein the first and second interlocking members are constructed and arranged to selectively interlock to hold the mouth in a closed position;

the male closure profile further comprising a sealing protrusion extending in a direction toward the female closure profile;

the female closure profile further comprising a sealing recess sized and located to receive the sealing protrusion extending from the male closure profile when the interlocking members of the male closure profile and the female closure profile are interlocked; and a slider device operatively mounted on the zipper closure, the slider device being configured to interlock the male closure profile with the female closure profile when the slider device is moved in a first direction and disengage the male closure profile from the female closure profile when the slider device is moved in a second, opposite direction, the slider device having a plow depending from the top wall of the slider device, the plow configured to separate the male closure profile from the female closure profile when the slider device is moved in the second, opposite direction, the plow extending past the first interlocking member formed on the male closure profile when the slider device is operatively mounted on the zipper closure;

wherein said male and said female closure profiles include a notch positioned adjacent to one of the first and second side edges of the reclosable package, the notch having a depth greater than the length of the plow of the slider device, wherein the slider device includes a first sidewall and a second sidewall joined to each other by a top wall to define a cavity for receiving the male closure profile and the female closure profile; and a first seal region formed between the pair of side panels adjacent to one of the first and second side edges, the first seal region being positioned below the notch formed in the male and female closure profiles.

7. The reclosable package of claim 6 wherein the slider device extends from a first end to a second end, the slider device further comprising a slider rib formed on each of the first and second sidewalls.

8. The reclosable package of claim 7 wherein the slider ribs disposed on the first and second sidewalls of the slider device are positioned to contact the first base wall of the male closure profile and the second base wall of the female closure profile to urge the male closure profile into contact with the female closure profile as the slider device is moved in the first direction.

9. The slider device of claim 8 wherein the height of each slider rib from the first sidewall and the second sidewall of the slider device decreases from the first end of the slider device to the second end of the slider device, wherein the plow is formed at the second end of the slider device.

10. The reclosable package of claim 6 wherein the female closure profile includes a spring member extending from the second interlocking member, wherein the spring member contacts the top wall of the slider device when the slider device is operatively positioned along the zipper closure.

11. The reclosable package of claim 6 wherein the male closure profile includes a spring member extending from the first base strip, wherein the spring member contacts the top wall of the slider device when the slider device is operatively positioned along the zipper closure.

12. The reclosable package of claim 6 wherein the female closure profile further comprises a spring member extending from the second interlocking member and the male closure profile further comprises a spring member extending from the first base strip, wherein the spring members formed on the female closure profile and the male closure profile contact the top wall of the slider device when the slider device is operatively positioned on the zipper closure.

13. The reclosable package of claim 6 wherein the first sidewall of the slider device includes a first shoulder extending toward the second sidewall and the second sidewall includes a second shoulder extending toward the first sidewall, wherein the pair of shoulders entrap the male closure profile and the female closure profile within the internal cavity.

14. The reclosable package of claim 6 wherein the sealing protrusion formed on the male closure profile is positioned between the first interlocking member and the open package interior and the sealing recess formed on the female closure profile is positioned between the second interlocking member and the package interior.

15. A reclosable, flexible package comprising:

a pair of side panels joined along a first side edge and a second side edge, the panels defining a mouth providing access to a package interior;

a zipper closure positioned along the mouth of the package for selectively opening and closing the package mouth, the zipper closure including a male closure profile and a female closure profile each constructed and arranged to selectively interlock with each other to hold the mouth in a closed position;

the male closure profile having a first base wall including a first interlocking member extending therefrom;

the female closure profile having a second base wall including at least one second interlocking member extending therefrom;

wherein the first and second interlocking members are constructed and arranged to selectively interlock to hold the mouth in a closed position;

a slider device operatively mounted on the zipper closure, the slider device being configured to interlock the male closure profile with the female closure profile when the slider device is moved in a first direction and disengage the male closure profile from the female closure profile when the slider device is moved in a second, opposite direction;

wherein the slider device includes a first sidewall and a second sidewall joined to each other by a top wall to define a cavity for receiving the male closure profile and the female closure profile;

the female closure profile further comprising a first spring member extending from the female closure profile and contacting the top wall of the slider device when the slider device is operatively mounted on the zipper closure; and the male closure profile further comprising a second spring member extending from the male closure profile and contacting the top wall of the slider device when the slider device is operatively mounted on the zipper closure.

16. The reclosable package of claim 15 wherein the female closure profile includes a pair of second interlocking members that define a channel to receive the first interlocking member of the male closure profile.

17. The reclosable package of claim 15 wherein the first spring member extends from the second interlocking member of the female closure profile and the second spring member extends from the base wall of the male closure profile.

18. The reclosable package of claim 17 wherein the slider device extends from a first end to a second end, the slider device further comprising a slider rib formed on each of the first and second sidewalls, the slider ribs being disposed on the first and second sidewalls of the slider device to contact the first base wall of the male closure profile and the second base wall of the female closure profile to urge the male closure profile into contact with the female closure profile as the slider device is moved in the first direction.

19. The slider device of claim 18 wherein the height of each slider rib from the first sidewall and the second sidewall of the slider device decreases from the first end of the slider device to the second end of the slider device, wherein the plow is formed at the second end of the slider device.

20. The reclosable package of claim 15 wherein the slider device further comprises a plow depending from the top wall of the slider device, the plow configured to extend between the first interlocking member and the second interlocking member to separate the male closure profile from the female closure profile when the slider device is moved in the second, opposite direction.

21. The reclosable package of claim 20 wherein the slider device is a monolithic structure extending from the top wall of the slider device.

* * * * *